United States Patent [19]

Darrell

[11] 4,116,450

[45] Sep. 26, 1978

[54] BOARD GAME APPARATUS

[75] Inventor: Robert William Darrell, Fort Myers, Fla.

[73] Assignee: Bigfoot Industries, Inc., Cape Coral, Fla.

[21] Appl. No.: 753,988

[22] Filed: Dec. 27, 1976

[51] Int. Cl.[2] ..... A63F 3/00

[52] U.S. Cl. ..... 273/249

[58] Field of Search ..... 273/134 AE, 134 AD, 273/134 C, 134 D, 134 E, 134 GP, 134 AC

[56] References Cited

U.S. PATENT DOCUMENTS

| | | | |
|---|---|---|---|
| 878,334 | 2/1908 | Bowers | 273/134 D |
| 1,310,259 | 7/1919 | Thomas | 273/134 D |
| 1,338,493 | 4/1920 | Cress | 273/134 AD |
| 1,642,711 | 9/1927 | Alfonso | 273/134 AD |
| 1,656,943 | 1/1928 | Firestone | 273/134 B |

*Primary Examiner*—Richard C. Pinkham
*Assistant Examiner*—Harry G. Strappello
*Attorney, Agent, or Firm*—William A. Newton

[57] ABSTRACT

A game apparatus is disclosed which includes a playing board or mat having a playing surface with a plurality of trails leading from a starting point to an ending point where "Bigfoot" is captured. This playing surface is combined with movable playing pieces, the movement of which is governed by the elements of chance incorporated into a subsidiary card game. This card game generates the number of spaces which the moving piece may move forward by matching cards having displayed thereon a left foot print with cards having displayed thereon a right foot print. Additionally, bonus and wild cards are provided.

4 Claims, 6 Drawing Figures

BOARD GAME APPARATUS

FIELD OF THE INVENTION

This invention relates to a game or more particularly relates to a path game with playing pieces movable in accordance with the elements of chance incorporated in a deck of cards.

PRIOR ART

In the prior art there exists various multiple path games, for which movement down the paths are in accordance with number chance device such as dice. Such apparatus can be found in the following references; U.S. Pat. Nos. 1,357,109, 1,642,711, 3,414,264, D 132,124.

SUMMARY

The invention relates to a game apparatus combining a playing surface with movable playing pieces, the movement of which is governed by a unique combination of the elements of chance. These elements of chance are incorporated into a deck of cards used in the random selection of indicia for determining the number of spaces that a playing piece may move down a plurality of trails.

A game board or mat having a playing surface is provided with the playing surface having a plurality of color coded trails. Each of the trails has an equal number of spaces, or more specifically foot print configured spaces. Each trail has a beginning point and a ending point with an equal number of spaces therebetween. Preferably, each of the plurality of trails begin and end at the same point. The object of the game is to capture big foot which is abstractly located at the end point. Therefore the first player to reach big foot wins the game.

Each player is provided with a playing piece for movement only along the player's trail. This playing piece will be moved along the trail by an integer number of spaces in accordance with the indicia number randomly selected by use of the playing cards. Additionally, the foot print configured spaces are aligned with the center line of the winding trails so that if the playing piece lands on a space facing in a backward direction relative to progressing toward the end of the trail the player will have to return to the start position and begin over again.

The playing board in the preferred embodiment includes four winding trails that overlap each other on the playing surface of a substantially rectangular game board. At the starting point there is a labled area entitled "start" and at the ending point there is a labled area entitled "big foot".

To begin each player selects a color which preferably will correspond to the color of the player's trail and the player's playing piece. A deck of playing cards is provided. Each of these playing cards will have displayed thereon a number or indicia indicating the number of steps which a player may move his playing piece along his trail. One group of cards of this deck will have displayed thereon a left or right foot print of each player's color. The object of these cards is for the player to get a complete set of his own color foot prints which would include a left and right foot print with the same indicia. Having matched the color, indicia and a corresponding left and right foot print, he may utilize this pair of cards to move forward on the board the amount shown by the indicia. In addition, this deck of cards includes a plurality of wild cards with each having a color corresponding to one of the player's colors and having displayed thereon an indicia to determine as before the number of spaces to be moved. The player upon having a wild card of his color distributed to him, can proceed to move his playing piece the number of spaces as dictated by the indicia without the need to match left and right foot prints. Also provided in this deck of cards is a bonus card which can be used by any player regardless of his color.

First the cards are shuffled and each player is dealt a plurality of cards. The shuffled deck is then placed face down on a table or other convenient supporting surface. The first player will then pick at least one card from the shuffled deck. If the player has a complete set of left and right foot prints of his color and the same indicia after picking from the deck, the player then moves the amount shown by the indicia and discards the matching pair to a discard stack. Likewise, if the player has a wild card of his color, or a bonus card, the player moves the amount shown by the indicia and discards the wild card or bonus card to the discard stack. Before the player passes to the next player, the player must have the number of cards which the player was originally dealt. If the player has more than the dealt number, the player must discard the surplus to the discard stack. If the player has less than the dealt number, the player must select the deficient number from the shuffled stack. As with the first player, the next player will pick at least one card from the shuffled deck or alternatively unlike the first player, the next player may select from the discard stack. Then the next player proceeds as the first player did. When all the shuffled cards are used the discard stack is reshuffled and becomes the new shuffled deck. Additional procedures prevent the next player from using a bonus card discard to the discard stack by the prior player. Also a player who lands on a foot print facing in the opposite direction from the direction of the path proceeding to the end must return to the start position and begin over again. Furthermore, for a player to win the game, he must land on the last foot print in his trail using the exact amount of jumps to reach it.

A primary object of the present invention is to provide a playing surface containing a plurality of trails with playing pieces for movement down the trails, the movement of which is governed by the elements of chance incorporated into a subsidiary card game.

A related object of the present invention is to provide a game which can be readily understood as to objects and manner of playing so that persons of any age group can enjoy and play the game.

DESCRIPTION OF THE DRAWINGS

Further objects and advantages of the present invention will become apparent as the following description proceeds, taken in conjunction with the accompanying drawings in which.

DETAILED DESCRIPTION OF THE PREFERRED EMBODIMENT

The present invention relates to a game board apparatus which combines a playing surface 3 having a plurality of trails with movable playing pieces 15. The movement of each of these playing pieces 15 will be confined to one of the trails 5, with the displacement along the trail being governed by the appearance of the proper per-determined combination on randomly selected cards 25.

Figure 1:
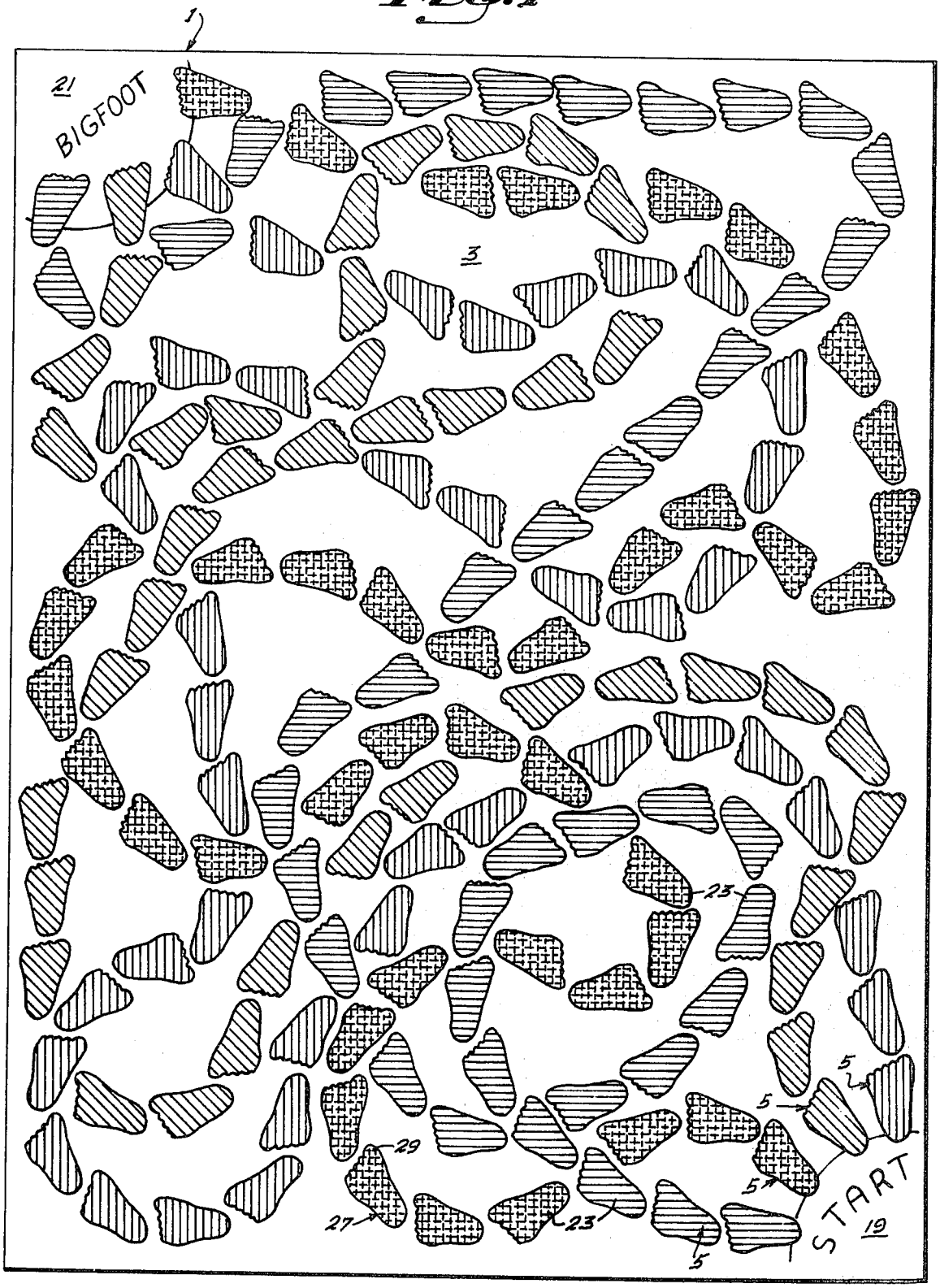
FIG. 1 is a plan view of a playing surface.

Referring to FIG. 1 of the drawings, there is illustrated the playing surface 3 having thereon a plurality of trails, generally indicated as 5. In the preferred embodiment, this playing surface 3 is disposed upon a game board 1. However, this playing surface could be laid out on a flexible material, such as canvass. In the preferred embodiment, the playing surface 3 is shown as being substantially rectangular. However, other configurations can be readily used with this game. The game board of the preferred embodiment can also be designed to be foldable into halves or quarters around hinged score lines.

As shown in FIG. 1, within the game board 1 on the top surface thereof there is the playing surface 3 composed of a plurality of trails 5. Ideally, as shown in FIG. 1, there will be four winding trials 5, being illustrated as having the colors of green, yellow, blue and red. The colors can clearly be varied as desired, with the four being depicted in FIG. 1 merely for the purposes of illustration. Although four trails 5 are shown, a greater or lesser number of trails 5 could be incorporated into the present invention. Each of the trails 5 are provided with spaces 23 over which the playing pieces 15 are moved in accordance with the outcome of the distributed cards 25. These spaces take on the configuration of a foot print with the foot print being disposed with it longitudinal dimensions aligned with the center line of the trails 5. Each trail contains the same number of foot prints that each player will follow. The playing surface has a starting position 19 disposed in one corner and labled "Start" and the opposite corner diagonally disposed therefrom, is end position 21 labled "Big foot". Each of the plurality of trails 5 begin at the start position 19 and proceed to extend outward therefrom in a winding fashion, terminating in the end position 21. Relative to proceeding from the start position 19, most of the foot prints 27 forming the trails 5 would have the toe portions 29 of the foot prints disposed outwardly along the center line of the trail with an occasional foot print along the trail being reversed relative to the majority of the foot prints so that the foot print points backward along the center line of the trail.

Figure 2:
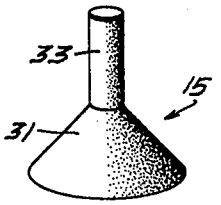
FIG. 2 is a perspective view of a playing piece.

The playing pieces 15 each have a different color with there being one playing piece for each trail 5. The color of the playing piece will correspond to the color of the matching trail 5. Although a playing piece 15 is shown in FIG. 2 with a base 31 and a neck 33, any suitable piece which can be easily moved around the playing surface 3 of the present invention is suitable for use therewith.

Figure 3:
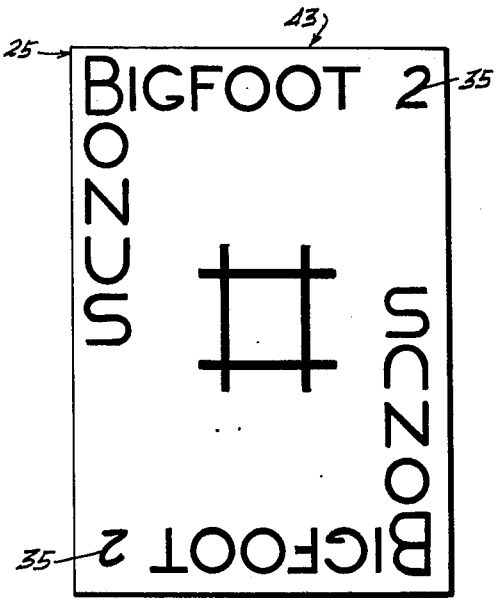
FIG. 3 shows a bonus card.
Figure 4:
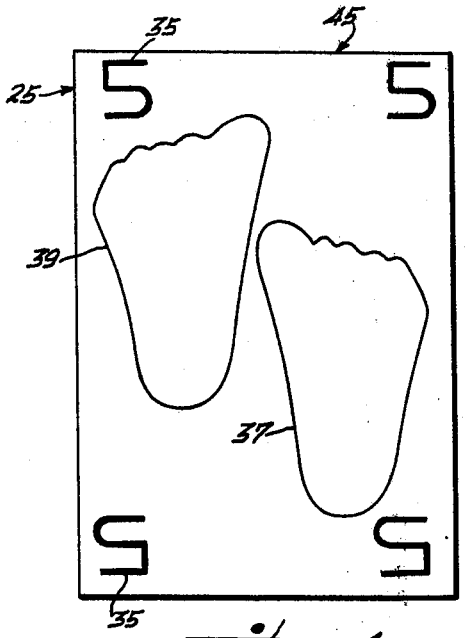
FIG. 4 shows wild card.
Figure 5:
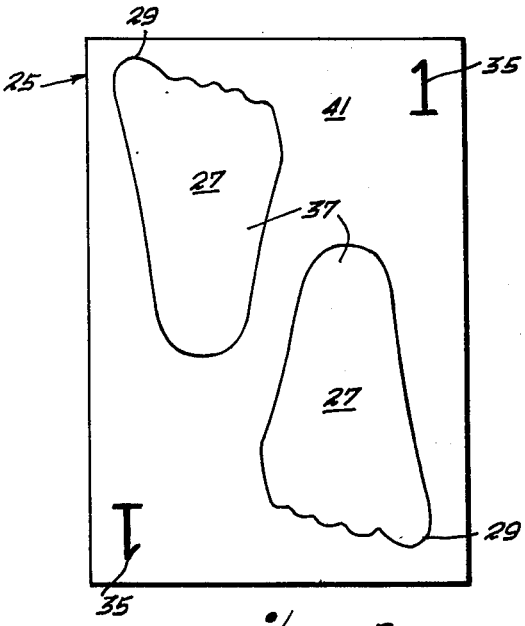
FIG. 5 shows an oppositely disposed right footprint card.
Figure 6:
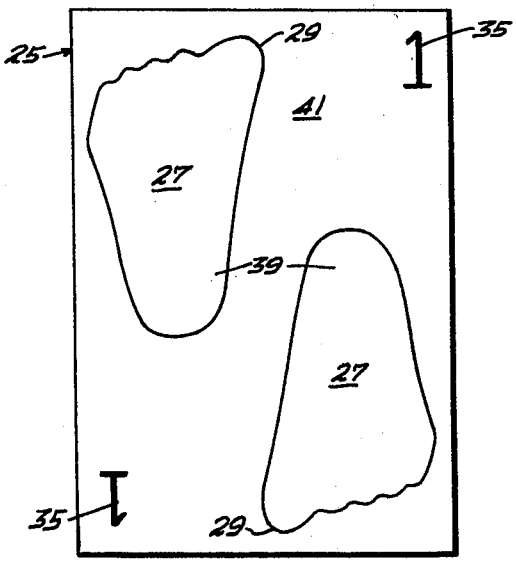
FIG. 6 shows an oppositely disposed left footprint card.

As shown in FIG. 3, the playing surface 3 with the playing pieces 15 are to be used in conjunction with a deck of cards. Ideally, for four trails 5, there should be a hundred and eight cards totally. These cards 25 are provided with matching information and indicia on one surface to distinguish them in value from one another while being blank on the other surface, to conceal the displayed information. In oppositely disposed diagonal corners of each card is a number from one to five which will indicate the number of moves a player can make. In this context, one move consists of directing the playing piece 15 from one foot print to the next foot print disposed in a forward proceeding position along the path. For each of the indicia 35 from the numbers 1 through 4, there are six cards of the same color. Each of these cards have displayed thereon a pair of right foot prints 37 or a pair of left foot prints 39. This pair of foot prints will have each foot print aligned substantially 180° out of alignment relative to each other so that the toe portions 29 of each foot is pointing in a direction opposite relative to the toe portions 29 of the other foot print 27. In addition, the foot prints will be marked in a distinct manner to correspond to the color of one of the trails 5. The important information displayed by these cards is the number of steps and whether there is a right or left foot and the color of the foot. The number of the foot prints and their disposition relative to each other serves no particular functional purpose in the present game. Since there are six cards for each of the number of steps indicia 35 from one to four and for each of the trails 5, there will be in the preferred embodiment 96 such cards with reversed pairs of foot prints 27. However, if the number of trails of the present game are increased or decreased, the number of such oppositely disposed foot print cards 41 would increase or decrease. Additionally, it is well within the scope of this invention to increase or decrease the number of cards, ideally set at six, to a different number. The preferred embodiment, in addition to the 96 cards described above, has eight "big foot bonus" cards in the deck. As with the oppositely disposed foot print cards 41, the bonus cards 43 include the number of steps indicia 35 in oppositely disposed diagonal corners of the card 25. Each of these number of steps indicia can range from one to four as previously described with the oppositely disposed foot print cards 41. Ideally the bonus cards 43 are labled in such a manner indicating all colors that are used in all of the trails 5. Additionally, there are four wild cards 45 in the deck. These cards are distinguished from the other cards of the deck by having a pair of foot prints, one left and one right aligned in a normal disposition. Also the number of steps indicia is ideally set at 5. However, other indication of value may be indicated on the face of the wild cards.

Ideally, as already indicated, the playing pieces are distinctly marked with colors that correspond to the colors of one of the trails. However, different configured shapes of the playing pieces 15 could be utilized to identify which playing piece 15 corresponds to which trail 5. Generally, the playing piece 15 should be dimensioned to fit without extensive overlapping on one of the foot prints 27. Likewise, the starting position 19 should be dimensioned so as to have sufficient area to include all of the playing pieces 15 simultaneously at one time. As shown in FIG. 1, the starting and stopping positions 19 and 21 respectively have a semi-circle configuration disposed at opposite diagonal corners.

The big foot game board apparatus is, as shown in the preferred embodiment, a game for two, three, or four players. As already indicated, with addition of more trails 5, the game could be expanded to accomodate more players. The object of the game is to capture "big foot" which is located at the end position 21. As shown in the preferred embodiment, there are four separate trails 5 leading from the start position 19 to big foot at the end position 21.

Each player selects a color and will receive the corresponding playing piece 15 having such color. For example, if there are three players there will be three playing pieces 15 of different colors positioned initially in the starting position 19. To determine how many moves each player can make the deck of cards is provided. When the player has a complete set of his own colored foot prints, both left and right, with the same number of steps indicia 35, he may move forward on the board by the number of indicia 35 shown. For example, if the number of indicia 35 is three the player will proceed forward foot prints 27. The player will be able to obtain a matching set of left and right foot prints 27 by either matching up a pair of oppositely disposed foot print cards 41 having the same color, the same number of steps indicia 35, and one with a left foot with the other having a right foot. Alternatively, the player may obtain a wild card already having a matching left and right foot displayed thereon or obtain a bonus card not requiring the matching of a left and right foot print.

The procedure for the game is as follows. First the deck of cards is shuffled. Each player is dealt five cards. The deck is then placed down on the table with the blank side of the cards facing up. The play passes to the left. The first player picks a card from the deck on the table. At this point, if a player has a complete set of foot prints after picking one card from the deck, the cards containing the corresponding left and right foot prints are laid on the table for the other players to verify. The player then moves the amount shown by the number of steps indicia 37 that is found on the cards placed on the table. These card or cards with the corresponding foot prints are then discarded by placing them in a stack with other discarded cards. Likewise, if the player has a wild card of his color or a bonus card, the player moves the amount shown by the indicia and discards the wild card or bonus card to the discard stack. Before the play passes to the next player, the player must have the number of cards which the player was originally dealt, which was five. If the player has more than five, the player must discard the surplus to the discard stack. If the player has less than five, the player must select the deficient number from the shuffled stack. As mentioned, these discarded cards are positioned face up so that there will always be a discard stack with one card showing its matching information. The next player will now have his turn. The next player, unlike the first player, has the option of either choosing one card from the shuffled stack or from the discard stack, assuming a discard has been created. After this point, the next player proceeds in the same manner as the first player. Likewise, every subsequent player proceeds in the same manner as the player after the first player. When all the cards are depleated from the shuffled stack, the discard stack is reshuffled and is turned face down to be the new shuffled stack. When a player discards a bonus card, the next player can not pick this card from the discard stack and use it, but must pick from the shuffled stack. Clearly, when the previous player has discarded a card of a different color from the next player, the player will be forced to use the shuffled deck.

The bonus card can be used by any of the players for the number of steps indicia so indicated thereon. The wild card is similar to the bonus card, except the player can only use a wild card of his color.

If a player lands on a foot print that is facing in the opposite direction relative to the direction proceeding outwardly along the path from the starting position 19, he must return to the start position 19 and begin over again. For a player to win the game, he must land on the last foot print in his trail using the exact amount of jumps to reach it. For example, if a player needs only one move to win the game, and draws a pair of foot prints with the number 2 on them, they can not be used.

The rules for the game are modified so that when there are only two players, the cards can not be selected by the player from the discard stack.

Although particular embodiments of the invention have been shown and described in full here, there is no intention to thereby limit the invention to the details of such embodiment. On the contrary, the invention is to cover all modifications, alternatives, embodiments and usages and equivalents of a game as fall within the spirit and scope of the invention, specification and appended claims.

What is claimed is:

1. A game apparatus comprising, a playing surface, said playing surface having a plurality of trails, each said trail having a plurality of spaces, each said trail having a beginning point and an ending point, each trail having an equal number of spaces between said beginning and end points of said trail, each said trail having one movable playing piece which can only move along said trail, random indicia selection means for determining number of spaces said playing piece may move down said trail, said random indicia selection means including a deck of playing cards, each said space having a foot print configuration, each said space being aligned with its longitudinal axis substantially parallel with the center line of said trail, at least one of said plurality of spaces of each said trail is aligned with its toes in reverse disposition relative to the balance of said plurality of spaces, part of said cards having displayed thereon at least one left foot print, part of said cards having displayed thereon at least one right foot print and said part being equal in number to said cards having displayed thereon a left foot print, each said left foot print card having displayed thereon a left foot print card combination of player's identification and indicia equal to the number of spaces said playing piece may move, each of said right foot print cards having displayed thereon a right foot print card combination of player's identification and indicia equal to the number of spaces said playing piece may move, each said right foot print card combination of player's identification and indicia matching at least one said left foot print card combination of player's identification and indicia.

2. A game apparatus as in claim 1, each of said trails being disposed in winding-trail configuration within the confines of said playing surface, said trails being disposed in overlapping relationship to each other.

3. A game apparatus as in claim 1, said player's identification comprising a color code, said trails each having a color code corresponding to said color code of said player's identification.

4. A game apparatus as in claim 1, said plurality of trails comprising four, said cards including three said left foot print cards for each said left foot print combination of player's identification and indicia.

* * * * *